US006043200A

United States Patent [19]

Carroll et al.

[11] Patent Number: 6,043,200

[45] Date of Patent: Mar. 28, 2000

[54] OLEAGINOUS COMPOSITIONS

[75] Inventors: Dale Robert Carroll, Rahway, N.J.; Brid Dilworth, Botley; Michele Anne Thornhill, Didcot, both of United Kingdom

[73] Assignee: Exxon Chemical Patents, Inc., Linden, N.J.

[21] Appl. No.: 09/114,971

[22] Filed: Jul. 13, 1998

Related U.S. Application Data

[63] Continuation-in-part of application No. 08/776,376, filed as application No. PCT/EP95/03056, Jul. 31, 1995, abandoned.

[51] Int. Cl.[7] ..... C10M 135/02

[52] U.S. Cl. ..... 508/332; 508/363

[58] Field of Search ..... 508/332, 363; 585/1, 2

[56] References Cited

U.S. PATENT DOCUMENTS

| | | |
|---|---|---|
| 4,147,640 | 4/1979 | Jayne et al. . |
| 4,228,022 | 10/1980 | Lowe et al. . |
| 4,664,825 | 5/1987 | Walsh . |

FOREIGN PATENT DOCUMENTS

| | | | |
|---|---|---|---|
| 0 107 282-A2 | 5/1984 | European Pat. Off. | C10M 1/38 |
| 0 134 014-A2 | 3/1985 | European Pat. Off. | C10M 127/00 |
| 134014 | 3/1985 | European Pat. Off. . | |
| 0 190 023-A2 | 8/1986 | European Pat. Off. | C07F 9/165 |
| 0 208 560-A2 | 1/1987 | European Pat. Off. | C10M 129/93 |
| WO 84/04319 | 11/1984 | WIPO | C09F 9/165 |
| WO 85/04896 | 11/1985 | WIPO | C10M 135/30 |
| WO 86/02638 | 5/1986 | WIPO | C07C 148/00 |
| WO 86/03772 | 7/1986 | WIPO . | |
| WO 86/04601 | 8/1986 | WIPO | C10M 135/00 |
| WO 86/04602 | 8/1986 | WIPO | C10M 135/00 |
| 88/02771 | 4/1988 | WIPO . | |

*Primary Examiner*—Jacqueline V. Howard
*Assistant Examiner*—Cephia D. Toomer
*Attorney, Agent, or Firm*—Ohlandt, Greeley, Ruggiero & Perle

[57] ABSTRACT

The compatibility with nitrile ester seals of lubricating compositions containing active sulphur-containing additives may be enhanced bt treating the additives, or concentrates containing them, or the composition themselves, with one or more olefinically unsaturated compounds selected from:

(a) acyclic compounds having at least two double bonds with adjacent double bonds separated by two saturated carbon atoms;

(b) compounds containing an acyclic ring, which ring contains at least, eight carbon atoms and at least two double bonds, each double bond being separated from the closest adjacent double bond(s) by two saturated carbon atoms; and (c) compounds containing a saturated alicyclic ring and at least one exocyclic double bond.

17 Claims, No Drawings

OLEAGINOUS COMPOSITIONS

RELATED APPLICATION

This application is a continuation-in-part of prior application Ser. No. 08/776,376 filed Jan. 30, 1997, now abandoned, as the USA National Phase Application of PCT Application No. PCT/EP95/03056 filed Jul. 31, 1995 based on British priority Application No. 9415623.9 filed Aug. 1, 1994.

FIELD OF THE INVENTION

The invention is concerned with improving the longterm reliability of elastomeric seals, and is concerned in particular with enabling nitrile seals in engines to meet the stringent requirements arising from modern engine design and operating conditions, and environmental considerations.

BACKGROUND OF THE INVENTION

Power trains, for example, automotive power trains require shaft and bearing seals to prevent lubricants leaking out and to prevent the ingress of contaminants. Seal life depends on, inter alia, the suitability of the chosen seal for the use to which it is put, the degree of care used in installing the seal, the temperatures to which the seal is exposed in use, the nature of the lubricants with which the seal comes into contact, and the condition of the surface(s) with which the seal comes into contact during use. Seal failure will in most cases lead to leakage of lubricants, which is increasingly regarded as unacceptable, and seals which can no longer perform their intended function must normally be replaced. There is thus a need for the life of seals to be prolonged for as long as possible.

International Specification No. WO 85/04896 indicates that labile sulphur-free additives for lubricants can be obtained by treating additives containing labile sulphur with copper, or copper and another material reactive with labile sulphur, or with an olefin, particularly an α-olefin, α-olefins containing 4 to 30 carbon atoms, especially 10 to 20 carbon atoms, being preferred. The olefins mentioned in the Examples are all $C_{15-18}$ or $C_{16-18}$ α-olefins.

$C_{15-18}$ α-olefins are also the preferred compounds for use in the process described in U.S. Pat. No. 4,228,022. More generally, it is indicated that the olefins preferably contain 10 to 30 carbon atoms, especially 15 to 20 carbon atoms, and may be straight chain or branched.

European Specification No. 151 581 B is concerned with the preparation of lubricating oil additives which have sufficiently low levels of active sulphur to ensure that lubricants containing the additives are non-staining and non-corrosive to copper and similar materials. Olefinically unsaturated compounds containing 8 to 36 carbon atoms are used. The olefinically unsaturated compounds are compounds containing one or more non-aromatic double bonds, and may be linear or alicyclic. α-Olefins are preferred, particularly $C_{16-18}$ α-olefins, although other types of olefinically unsaturated compounds are referred to.

The reaction of a sulphurized substance with an olefin to reduce the corrosivity of the product is also disclosed in U.S. Pat. No. 4,147,640, which is concerned with the preparation of lubricating oil antioxidant additives which are free from metals and phosphorus, and which have the ability to protect copper-lead bearings from corrosion. The olefins used contain about 6 to 18 carbon atoms and 1 to 3 olefinic double bonds. The preferred compounds are cyclopentadiene dimers and alloocimene.

Other specifications which disclose lubricating oil compositions containing, among other things, oil-soluble sulphur-containing organic compounds are International Specifications Nos. WO 86/04601, WO 86/04602, WO 86/03772 and WO 86/02638, and U.S. Pat. No. 4,664,825. All five of these specifications refer to the possibility of reducing the active or unreacted sulphur content of sulphurized organic compounds by treating the compounds with an alkali metal sulphide. The specifications also indicate that the compositions disclosed show good nitrile seal compatibility.

The applicants have now discovered that the life of nitrile elastomer seals can be significantly enhanced, when lubricating compositions in contact with such seals contain active sulphur, by the inclusion in the compositions of certain olefinically unsaturated compounds. By "active" sulphur is meant sulphur, including elemental sulphur, which attacks nitrile elastomers.

Whilst the problems of seal compatibility and copper corrosion have been addressed by the prior art in relation to sulphur-containing additives, there is still a need for improved or alternative products or processes for improving compatibility of such additives with elastomeric seals, in particular nitrile seals. The problem of seal compatibility seriously impairs the utility of sulphur-containing additives in lubricating oil compositions which come into contact with nitrile seals.

SUMMARY OF THE INVENTION

The applicants have surprisingly found that the use of certain selected olefinically unsaturated compounds to treat an active sulphur-containing lubricating oil additive, concentrate, or composition can bring about a particularly marked enhancement in the life of nitrile elastomer seals. The invention is of particular use for lubricants, such as lubricants for heavy duty diesel engines which normally contain a relatively high level of sulphur-containing substances.

The present invention provides a lubricating composition obtainable by mixing:

(1) a major proportion of lubricating oil;

(2) an oil-soluble active sulphur-containing additive, and (3) an oil-soluble olefinically unsaturated compound selected from:

(a) acyclic compounds having at least two double bonds, adjacent double bonds being separated by two saturated carbon atoms;

(b) compounds containing an alicyclic ring, which ring contains at least eight carbon atoms and at least two double bonds, each double bond being separated from the closest adjacent double bond(s) by two saturated carbon atoms; and (c) compounds containing a saturated alicyclic ring and at least one exocylic double bond.

The invention also provides a treatment method which comprises treating an active sulphur-containing lubricating oil additive, concentrate, or composition with an olefinically unsaturated compound as specified in the preceding paragraph.

DETAILED DESCRIPTION OF THE INVENTION

The invention further provides the use of an olefinically unsaturated compound selected from (a), (b) and (c) above to increase the nitrile elastomer compatibility of a lubricating composition containing sulphur and/or a sulphur-containing compound having a deleterious effect on the elastomer. For example, an olefinically unsaturated compound selected from (a), (b) and (c) above may be used to reduce the tendency of a nitrite etastomer to be degraded by a lubricating composition containing sulphur and/or a sulphur-containing compound, and may thus be used to enhance the life of an engine seal in contact with such a composition.

Sulphur-containing additives are widely used in lubricating compositions as, for example, oxidation inhibitors, extreme pressure and antiwear agents, and/or load-carrying additives, commonly used classes of sulphur-containing additives being sulphurized phenols, sulphurized olefins, and salts of phosphorus- and/or sulphur-containing acids, for example, phosphorodithioic acids and dithiocarbamic acids, although the invention is not confined to these particular classes of additives. In this invention the oil-soluble active sulfur-containing additive component (2) is not a diaalkyldithophosphoric acid salt when the oil-soluble olefinically unsaturated component (3) is present as component (a) or (c). That is, the sulfur-containing additive can be phosphorodithioate only when component (3) is present as component (b). Such additives may be used in lubricants, for example, crankcase lubricating oils, gear lubricants and metalworking lubricants, including various functional fluids, for example, hydraulic fluids, automatic transmission fluids and heat transfer fluids.

Sulphurized phenols include mono-, di- and polysulphides of phenols or alkyl phenols, salts thereof, and overbased salts thereof. The alkyl phenols may contain one or more alkyl groups per aromatic ring. Typical sulphurized alkyl phenols for use as lubricating oil additives may be represented by the formula

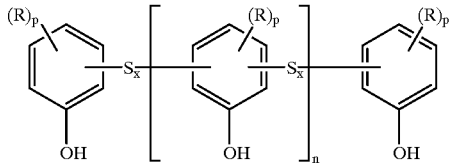

wherein R represents an alkyl radical, n is 0 or an integer of from 1 to 4, p is an integer of from 1 to 3, and x is an integer of from 1 to 4, the average number of carbon atoms in the alkyl group(s) being sufficient to ensure adequate solubility in oil. The individual groups represented by R typically contain from 5 to 40 preferably 8 to 20, carbon atoms. Metal salts of sulphurized phenols may be obtained by reacting an alkyl phenol sulphide with a sufficient quantity of metal-containing material, for example, a metal oxide or hydroxide, to obtain a neutral or, if desired, overbased sulphurized metal phenate. Processes for preparing overbased metal phenates are well known in the art, and do not need to be described further here.

Examples of sulphurized olefins, and other olefinically-unsaturated compounds, which may be used in lubricating compositions are given in the prior art referred to earlier in this specification for example, International Specifications Nos. WO 86/04601 and WO 86/02638 and U.S. Pat. No. 4,664,825.

Salts of phosphorodithioic acids include metal dihydrocarbyl dithiophosphates, for example, zinc dihydrocarbyl dithiophosphates (ZDDPs). Especially preferred ZDDPs for use in oil-based compositions are those of the formula $Zn[SP(S)(OR^1)(OR^2)]_2$ wherein $R^1$ and $R^2$ contain from 1 to 18, and preferably 2 to 12, carbon atoms. Particularly preferred as $R^1$ and $R^2$ radicals are alkyl radicals having 2 to 8 carbon atoms. Examples of radicals which $R^1$ and $R^2$ may represent are ethyl, n-propyl i-propyl, n-butyl, -butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl and butenyl radicals.

Salts of dithiocarbamic acids typically have the formula $[RR'NC(S)S]_nM$, wherein R and R' represent the same or different hydrocarbyl radicals containing 1 to 18, preferably 2 to 12 carbon atoms, for example, alkyl, alkenyl, aryl, aralkyl, alkaryl or cycloalkyl radicals. M may represent any suitable metal, for example molybdenum, zinc, or copper. Preferred dithiocarbamates for use in lubricating oil compositons are those containing 2 to 12 carbon atoms.

The sulphur-containing lubricating oil additives discussed above, and many other sulphur-containing lubricating oil additives, are typically prepared by processes in which a starting compound is reacted with sulphur and/or a sulphur-containing compound, for example, hydrogen sulphide or sulphur monohalide or dihalide. The sulphurized products, which will normally comprise a mixture of different compounds, typically contain at least some sulphur which is either free, or is only loosely bonded, the sulphur thus being available to attack nitrite elastomers: as indicated earlier, sulphur which attacks nitrite elastomers is referred to herein as "active sulphur".

A lubricant for a heavy duty diesel engine will typically contain from 0 to 3 mass % of a sulphur-containing compound such as a sulphurized alkyl phenol.

In accordance with the invention, an active sulphur-containing additive for a lubricating composition, the composition itself or, preferably, a concentrate for forming a lubricating composition containing such an additive, is treated with an oil-soluble olefinicaity unsaturated compound selected from:

(a) acyclic compounds having at least two double bonds, adjacent double bonds being separated by two saturated carbon atoms;

(b) compounds containing an alicyclic ring, which ring contains at least eight carbon atoms and at least two double bonds, each double bond being separated from the closest adjacent double bond(s) by two saturated carbon atoms; and (c) compounds containing a saturated alicyclic ring and at least one exocylic double bond.

More than one olefinically unsaturated compound selected from (a), (b) and (c) above may of course be used if desired. Where two or more compounds are used, these need not be compounds from the same group. Thus, for example, a compound selected from (a) may be used with a compound selected from (b) or (c).

Preferred compounds of group (a) are unsubstituted or substituted linear terpenes. Unsubstituted linear terpenes for use in accordance with the invention may be represented by the formula $(C_5H_8)n$ wherein n is at least 2, that is, a terpene containing carbon and hydrogen atoms only. A preferred unsubstituted linear terpene for use in accordance with the present invention is squalene (in which n in the above formula is 6). Possible substituents for linear terpenes to be used in accordance with the invention are, for example, hydroxyl groups.

Preferred substituted terpenes include geraniol and farnesol.

A preferred group (b) compound having two double bonds only is 1,5-cyclooctadiene. If desired, the group (b) compound may contain at least three double bonds, each end of each double bond being separated from each adjacent double bond by two saturated carbon atoms. A preferred group (b) compound having three double bonds is 1,5,9-cyclododecatriene.

The compounds of group (c) are compounds containing a saturated alicyclic ring and at least one exocyclic double bond. Advantageously, the exocyclic double bond, or one of the exocyclic double bonds, links a carbon atom in the said alicyclic ring and an exocyclic carbon atom. The alicyclic ring in the group (c) compounds preferably contains at least six carbon atoms, and, advantageously, the alicyclic ring is substituted by a methylene bridging group that forms a four-membered ring with three of the ring carbon atoms. The methylene carbon atom in such a bridging group may be substituted, preferably by two methyl groups. A particularly preferred group (c) compound is β-pinene.

It is believed that the aliphatic double bonds in the compounds used in accordance with the invention react with active sulphur in the additives, concentrates or oleaginous compositions treated with the compounds to "fix" the sulphur in a form in which it does not have a deleterious effect on nitrile seals, but the invention is not to be regarded as limited in any way by this explanation.

The compounds used in accordance with the invention are used in a proportion appropriate to the proportion of active sulphur in the additive, concentrate, or oleaginous composition to be treated, and the most appropriate proportion in any given case can be determined by routine experiment. In general, the use of 0.01 to 5 mass %, advantageously 0.05 to 1 mass %, preferably 0.05 to 0.5 mass % of the olefinically unsaturated compound(s), based on the final lubricating oil composition (including the olefinically unsaturated compound(s)) may be appropriate, although in some cases, for example, where the composition contains a relatively high proportion of active sulphur, the use of a somewhat higher proportion of the olefinically unsaturated compound may be desirable.

As indicated above, the olefinically unsaturated compound may be used to treat an active sulphur-containing lubricating oil additive, or a lubricating oil composition (a concentrate or a finished oil) containing such an additive. Advantageously, however, the compound is used to treat a concentrate which contains an active sulphur-containing additive and, optionally, one or more other additives, and which may be blended with an oil of lubricating viscosity and, optionally, one or more other additive concentrates or additives, to form the final lubricating oil composition. Other types of additive which may be present in a lubricating oil composition, particularly a crankcase lubricating oil composition, or an additive concentrate which may be used for preparing such a composition, include ashless dispersants, viscosity index modifiers, detergents, antiwear agents and antioxidants. Further details of these types of additives, and of concentrates and compositions containing them, are given later in this specification.

References in this specification to treating a first material with a second material are not to be understood as implying any particular order of mixing of the two materials. Thus, for example, the first material may be introduced into a vessel already containing the second material or vice versa, or the two materials may be introduced simultaneously into the vessel.

Treatment of an active sulphur-containing additive, concentrate or lubricating oil composition with an olefinicatly unsaturated compound used in accordance with the invention may be carried out by mixing at ambient temperature, but is preferably carried out at an elevated temperature. Thus, for example, where the olefinically unsaturated compound is added to a concentrate, the mixture is advantageously heated to a temperature of from 30 to 100° C., preferably 46 to 60° C., after addition of the olefinically unsaturated compounds, and is maintained at that temperature, with stirring, for a period that can readily be determined by the person skilled in the art.

Lubricating oil additives used or treated as described herein and the olefinically unsaturated compounds used in accordance with the invention to treat additives, concentrates, or compositions are oil-soluble or (in common with certain of the other additives referred to below) are dissolvable in oil with the aid of a suitable solvent, or are stably dispersible materials. Oil-soluble, dissolvable, or stably dispersible as that terminology is used herein does not necessarily indicate that the additives and compounds are soluble, dissolvable, miscible, or capable of being suspended in oil in all proportions. It does mean, however, that the additives and compounds are, for instance, soluble or stably dispersible in oil to an extent sufficient to exert their intended effect in the environment in which the oil is employed. Moreover, the additional incorporation of other additives may also permit incorporation of higher levels of a particular additive or compound, if desired.

Additives used or treated as described herein can be incorporated into the oil in any convenient way. Thus, they can be added directly to the oil by dispersing or by dissolving them in the oil at the desired level of concentrations optionally with the aid of a suitable solvent such for example, as toluene, cyclohexane, or tetrahydrofuran. In some cases blending may be effected at room temperature: in other cases elevated temperatures are advantageous.

Base oils with which the additives may be used include those suitable for use as crankcase lubricating oils for spark-ignited and compression-ignited internal combustion engines, for example, automobile and truck engines, marine and railroad diesel engines.

Synthetic base oils include alkyl esters of dicarboxylic acids, polyglycols and alcohols; poly-α-olefins, polybutenes, alkyl benzenes, organic esters of phosphoric acids and polysilicone oils.

Natural base oils include mineral lubricating oils which may vary widely as to their crude source, for example, as to whether they are paraffinic, naphthenic, mixed, or paraffinic-naphthenic, as well as to the method used in their production, for example distillation range, straight run or cracked, hydrofined, solvent extracted and the like.

More specifically, natural lubricating oil base stocks which can be used may be straight mineral lubricating oil or distillates derived from paraffinic, naphthenic, asphaltic, or mixed base crude oils. Alternatively, if desired, various blended oils may be employed as well as residual oils, particularly those from which asphaltic constituents have been removed. The oils may be refined by any suitable method, for example, using acid, alkali, and/or clay or other agents such, for example, as aluminium chloride, or they may be extracted oils produced, for example, by solvent extraction with solvents, for example, phenol, sulphur dioxide, furfural, dichlorodiethyl ether, nitrobenzene, or crotonaldehyde.

The lubricating oil base stock conveniently has a viscosity of about 2.5 to about 12 cSt or $mm^2$/sec and preferably about 3.5 to about 9 cSt or $mm^2$/sec at 100° C.

Additives used or treated as described herein may be employed in a lubricating oil composition which comprises lubricating oil, typically in a major proportion, and the additives, typically in a minor proportion. Additional additives may be incorporated in the composition to enable it to meet particular requirements. Examples of additives which may be included in lubricating oil compositions are viscosity index improvers, corrosion inhibitors, oxidation inhibitors, friction modifiers, dispersants, detergents, metal rust inhibitors, anti-wear agents, pour point depressants, and anti-foaming agents.

Viscosity index improvers (or viscosity modifiers) impart high and low temperature operability to a lubricating oil and permit it to remain shear stable at elevated temperatures and also exhibit acceptable viscosity or fluidity at low temperatures. Suitable compounds for use as viscosity modifiers are generally high molecular weight hydrocarbon polymers, including polyesters, and viscosity index improver dispersants, which function as dispersants as well as viscosity index improvers. Oil soluble viscosity modifying polymers generally have weight average molecular weights of from about 10,000 to 1,000,000, preferably 20,000 to 500,000, as determined by gel permeation chromatography or light scattering methods.

Corrosion inhibitors, also known as anti-corrosive agents, reduce the degradation of the metallic parts contacted by the lubricating oil composition.

Oxidation inhibitors, or antioxidants, reduce the tendency of mineral oils to deteriorate in service, evidence of such deterioration being) for example, the production of varnish-like deposits on the metal surfaces and of sludge, and viscosity growth. Suitable oxidation inhibitors include alkaline earth metal salts of alkyl-phenolthioesters having preferably $C_5$ to $C_{12}$ alkyl side chains, e.g., calcium nonylphenyl sulphide and barium octylphenyl sulphide dioctylphenylamine; phenylalpha-naphthylamine; and phosphosulphurized or sulphurized hydrocarbons.

Other oxidation inhibitors or antioxidants which may be used in lubricating oil compositions comprise oil-soluble copper compounds.

Friction modifiers and fuel economy agents which are compatible with the other ingredients of the final oil may also be included. Examples of such materials are glyceryl monoesters of higher fatty acids, for example, glyceryl mono-oleate, esters of long chain polycarboxylic acids with diols, for example, the butane diol ester of a dimerized unsaturated fatty acid, and oxazoline compounds.

Dispersants maintain oil-insoluble substances, resulting from oxidation during use, in suspension in the fluid, thus preventing sludge flocculation and precipitation or deposition on metal parts. So-called ashless dispersants are organic materials which form substantially no ash on combustion, in contrast to metal-containing (and thus ash-forming) detergents. Suitable dispersants include, for example, derivatives of long chain hydrocarbon—substituted carboxylic acids in which the hydrocarbon groups contain 50 to 400 carbon atoms, examples of such derivatives being derivatives of high molecular weight hydrocarbyl-substituted succinic acid. Such hydrocarbon-substituted carboxylic acids may be reacted with, for example, a nitrogen-containing compound, advantageously a polyalkylene polyamine, or with an ester. Such nitrogen-containing and ester dispersants are well known in the art, and require no further description here. Particularly preferred, dispersants are the reaction products of polyalkylene amines with alkenyl succinic anhydrides.

As indicated above, a viscosity index improver dispersant functions both as a viscosity index improver and as a dispersant. Examples of viscosity index improver dispersants suitable for use in lubricating compositions include reaction products of amines, for example polyamines, with a hydrocarbyl-substituted mono-or dicarboxylic acid in which the hydrocarbyl substituent comprises a chain of sufficient length to impart viscosity index improving properties to the compounds.

Detergents and metal rust inhibitors include the metal salts, which may be overbased, of sulphonic acids, alkyl phenols, sulphurized alkyl phenols, alkyl salicylates, naphthenates, and other oil-soluble mono- and dicarboxylic acids. Overbased metal sulphonates wherein the metal is selected from alkaline earth metals and magnesium, are particularly suitable for use as detergents. Representative examples of detergents/rust inhibitors, and their methods of preparation, are given in European Specification No. 208 560 A.

Antiwear agents, as their name implies, reduce wear of metal parts. Zinc dihydrocarbyl dithiophosphates, for example those mentioned above, are very widely used as antiwear agents.

Pour point depressants, otherwise known as lube oil flow improvers, lower the temperature at which the fluid will flow or can be poured. Such additives are well known. Typical of those additives which improve the low temperature fluidity of the fluid are $C_5$ to $C_{18}$ dialkyl fumarate/vinyl acetate copolymers, polymethacrylates, and wax naphthalene. Foam control can be provided by an antifoamant of the polysiloxane type, for example, silicone oil or polydimethy~siloxane.

Some of the above-mentioned additives can provide a multiplicity of effects; thus for example, a single additive may act as a dispersant-oxidation inhibitor. This approach is well known and need not be further elaborated herein.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | mass, % ai* (Broad) | mass % ai* (Preferred) |
|---|---|---|
| Viscosity Modifier | 0.01–6 | 0.014 |
| Corrosion Inhibitor | 0.01–5 | 0.01–1.5 |
| Oxidation Inhibitor | 0.01–5 | 0.01–1.5 |
| Friction Modifier | 0.01–5 | 0.01–1.5 |
| Dispersant | 0.1–20 | 0.1–8 |
| Detergents/Rust Inhibitors+ | 0.01–6 | 0.01–3 |
| Anti-wear Agent | 0.01–6 | 0.014 |
| Pour Point Depressant | 0.01–5 | 0.01–1.5 |
| Anti-Foaming Agent | 0.001–3 | 0.001–0.15 |
| Mineral or Synthetic Oil Base | Balance | Balance |

*Mass % active ingredient based on the final oil.
+Relatively larger proportions, for example, at least 10 mass % are normally used for marine applications.

When, a plurality of additives are employed it may be desirable, although not essential, to prepare one or more additive concentrates comprising the additives (a concentrate sometimes being referred to herein as an additive package) whereby several additives can be added simultaneously to the base oil to form the lubricating oil composition. Dissolution of the additive concentrate(s) into the lubricating oil may be facilitated by solvents and by mixing accompanied with mild heating, but this is not essential. The concentrate(s) or additive package(s) will typically be formulated to contain the additive(s) in proper amounts to provide the desired concentration in the final formulation when the additive package is/are combined with a predetermined amount of base lubricant. Thus, one or more additives treated in accordance with the present invention can be added to small amounts of base oil or other compatible solvents along with other desirable additives to form additive packages containing active ingredients in an amount, based on the additive package, ot for example, from about 2.5 to about 90 mass %, and preferably from about 5 to about 75 mass % and most preferably from about 8 to about 50 mass % by weight, additives in the appropriate proportions with the remainder being base oil. Alternatively, as indicated above, an olefinically unsaturated compound may be used to treat an additive package (concentrate) containing an active sulphur-containing compound.

The final formulations may employ typically about 10 mass % of the additive package with the remainder being base oil.

The following Examples illustrate the invention.

The ability of an olefinically unsaturated compound to reduce the adverse effect of active sulphur-containing lubricating oil additives on nitrile seals was tested by immersing samples of a nitrile elastomer in a lubricating oil composition containing an active sulphur-containing additive and the compound to be tested, and comparing the elongation at break (EAB) and/or tensile strength (TS) of the samples after immersion with the corresponding figures before immersion. The most effective compounds are those giving the smallest percentage loss in the elongation at break and/or tensile strength. Test Methods DIN 53521 and DIN 53504 were used.

EXAMPLE 1

A number of olefinically unsaturated compounds were tested in a lubricating oil composition containing 0.72 mass % nonyl phenol sulphide (NPS) and a dispersant, a detergent and an antioxidant, the elastomer being the acrylonitrile-butadiene rubber known as NBR 28. The percentage loss in elongation at break (EAB) when using no olefinically unsaturated compound and 0.1 mass % and 0.25 mass % respectively of each of the compounds tested is given in Table 1, the percentages being based on the total mass of the lubricating oil composition with the compound. The percentage losses in TAB for the base formulation without the nonyl phenol sulphide and including the nonyl phenol sulphide were 31% and 54% respectively.

TABLE 1

| | % Loss EAB | |
|---|---|---|
| Additive | 0.1% Additive | 0.25% Additive |
| *Squalene | 28 | 16 |
| *1,5,9-Cyclo-dodecatriene | 40 | 37 |
| α-Pinene | 50 | 50 |
| Limonene | 45 | 38 |
| 1,3-Cyclo-heptadiene | 52 | 42 |
| 1,3,5-Cyclo-heptatriene | 48 | 43 |
| Acenaphthylene | 49 | 49 |
| *β-Pinene | 42 | 28 |
| *Methylene cyclopentane | 45 | 34 |
| *Methylene cyctohexane | 32 | 32 |
| *Camphene | 50 | 50 |
| (Limonene | 45 | 38) |

It can be seen from Table 1, in which additives for use in accordance with the invention are indicated by an asterisk, that 0.1% squalene (a group (a) compound) gave a very significant reduction in loss of the elongation at break, compared with the figure (54%) for the base formulation containing the nonyl phenol sulphide, a further improvement being obtained by the use of 0.25% of this compound. Further, 1,5,9-cyclododecatriene, a group (b) compound, gave better results, at both 0.1% and 0.25% levels, than the other cyclic compounds containing endocyclic double bonds, namely α-pinene and limonene (which contain only one endocyclic double bond), 1,3-and 1,1,5-cycloheptatriene (in which the two endocyclic double bonds are not separated at both ends by two saturated carbon atoms), and acenaphthylene (which contains aromatic, rather than aliphatic, double bonds). With regard to group (C) compounds, p-pinene, methylene cyclopentane and methylene cyclohexane gave better results than limonene, in which the alicyclic ring is not saturated.

EXAMPLE 2

The general procedure described in Example 1 was followed, except that the olefinically unsaturated compounds were added to an additive concentrate containing 6.76 mass % nonyl phenol sulphide (NPS), based on the concentrate without the olefinically unsaturated compound (s), and the test was carried out on a different batch of NBR 28 nitrile seals. The concentrate also included a dispersant, a detergent and an antioxidant. The concentrate in each case was then diluted with oil to give a lubricating oil composition containing 0.72 mass % NPS, based on the finished oil. The compounds were added to the concentrate in such proportions as to give 0.1 mass % or 0.2 mass % of the compounds in the finished oil (including the compounds) Addition of the compounds to the concentrates was effected at 60° C. The results obtained are given in Table 2. The percentage losses in EAB for the base formulation without the nonyl phenol sulphide and including the nonyl phenol sulphide were 31% and 42% respectively The difference between the results obtained from the base formulations with the nonyl phenyl sulphide in Examples 1 and 2 was in part the result of using different batches of nitrile seats and in part a function of the test method used.

TABLE 2

| | % Loss EAB | |
|---|---|---|
| Additive | 0.1 mass % Additive | 0.2 mass % Additive |
| *Squalene | 22 | 18 |
| *Geraniol | 23 | 21 |
| *Farnesol | 25 | 22 |
| Decene 50 | 40 | 36 |
| Decene mix | 38 | 34 |
| Nonene | 37 | 36 |
| *1,5-Cyclo-octadiene | 40 | 35 |
| Limonene | 33 | 26 |
| Methyl-cyclopentadiene dimer 1,4-Cyclo-hexadiene | 44 | 42 |
| *β-Pinene | 32 | 19 |
| (Limonene | 40 | 35) |

It can be seen from Table 2, in which additives for use in accordance with the invention are indicated by an asterisk, that squalene, geraniol and farnesol, which are group (a) compounds, gave significantly better results than decene 50, decene mix and nonene, which are not suitable for use in accordance with the invention. Further, 1 5-cyctooctadiene (a group (b) compound), gave significant better results than limonene (which contains only one endocyclic double bond), methylcyclopentadiene (the compound tested was the dimer, which does not contain two endocyclic double bonds in the same ring), and 1,4-cyclohexadiene (in which the two endocyclic double bonds are not separated by two saturated carbon atoms). In addition, α-pinene (a group (c) compound), gave significantly better results than limonene (in which the alicyclic ring is not saturated). All the compounds which are compounds to be used in accordance with the invention gave better results than methylcyclopentadiene dimer, the most effective of those compounds in Table 2 which are not suitable for use in accordance with the invention.

EXAMPLE 3

The general procedure described in Example 1 was followed, except that the compounds to be tested, which were added to a lubricating oil composition containing 0.72 mass % nonyl phenol sulphide, based on the finished oil, were used in proportions of 0.05 mass %, 0.1 mass % and 0.3 mass % respectively, based on the finished oil (with the olefinally unsaturated compound), and the elastomer was the acrylonitrile-butadiene rubber known as NBR 34. The finished oil also contained a dispersant a detergent, and an antioxidant. The results obtained are given in Table 3. The percentage toss in EAB for the base formulation including the nonyl phenol sulphide was 47%.

TABLE 3

| | % Loss EAB | | |
|---|---|---|---|
| Additive | 0.05% Additive | 0.1% Additive | 0.3% Additive |
| *Squalene | 34 | 26 | 20 |
| *β-Pinene | 43 | 39 | 28 |
| *1,5,9-Cyclo-dodecatriene | 39 | 31 | 32 |
| α-Pinene | 50 | 50 | 47 |
| Dipentene | 49 | 48 | 43 |
| Cyclopentadiene dimer | 31 | 31 | 32 |

It will be seen from FIG. 3, in which additives for use in accordance with the invention are indicated by an asterisk, that at a treatment level of 0.3 mass %, squalene and β-pinene (which are compounds for use according to the invention) gave significantly better results than β-pinene and dipentene, and better results than cyclopentadiene dimer (which does not have two double bonds in the same alicyclic ring) and 1,5,9-cyclododecatriene.

We claim:

1. A lubricating composition comprising:

(1) a major proportion of lubricating oil;

(2) an oil-soluble active sulphur-containing additive; and (3) an oil-soluble olefinically unsaturated compound selected from:

(a) acyclic compounds having at least two double bonds, adjacent double bonds being separated by two saturated carbon atoms;

(b) compounds containing an alicyclic ring, which ring contains at least eight carbon atoms and at least two double bonds, each double bond being separated from the closest adjacent double bond(s) by two saturated carbon atoms; or (c) compounds containing a saturated alicyclic ring and at least one exocyclic double bond;

wherein the sulphur-containing additive is at least one additive selected from the group consisting of sulphurized phenols, sulphurized olefins, dithiocarbamates and, when component (3) is present as component (b), from phosphorodithioates; and provided that component (2) is not a dialkyldithiophosphoric acid salt when component (3) is present as component (a) or (c).

2. A lubricating composition as claimed in claim 1, wherein said olefinically unsaturated compound is as defined in (3) (a) and is a linear terpene.

3. A lubricating composition as claimed in claim 2, wherein said linear terpene is either squalene, geraniol, or farnesol.

4. A composition as claimed in claim 1, wherein said olefinically unsaturated compound is as defined in (3) (b) and contains hydrogen and carbon atoms only.

5. A lubricating composition as claimed in claim 1, wherein said olefinically unsaturated compound is 1,5-cyclooctadiene.

6. A lubricating composition as claimed in claim 1, wherein said olefinically unsaturated compound is as defined in (3)(b) and wherein said alicyclic ring contains at least three double bonds, each end of each double bond being separated from each adjacent double bond by two saturated carbon atoms.

7. A lubricating composition as claimed in claim 6, wherein said olefinically unsaturated compound is 1,5,9-cyclododecatriene.

8. A lubricating composition as claimed in claim 1, wherein said olefinically unsaturated compound is as defined in (3)(c) and wherein said exocyclic double bond, or one of said exocyclic double bonds, is between a carbon atom in said alicyclic ring and an exocyclic carbon atom.

9. A lubricating composition as claimed in claim 1, wherein said olefinically unsaturated compound is as defined in (3) (c) and said alicyclic ring contains at least six carbon atoms.

10. A lubricating composition as claimed in claim 8, wherein said alicyclic ring is substituted by a bridging group that forms a four-membered ring with three of the ring carbon atoms.

11. A lubricating composition as claimed in claim 8, wherein apart from a bridging group (if any) and a side chain containing said exocyclic double bond, the carbon atoms in the said alicyclic ring are unsubstituted.

12. A lubricating composition as claimed in claim 1, wherein said olefinically unsaturated compound is β-pinene.

13. A lubricating composition as claimed in claim 1, wherein said lubricating oil comprises a crankcase lubricating oil.

14. A lubricating composition as claimed in claim 1, further comprising at least one additive selected from the group consisting of: ashless dispersants, viscosity index modifiers, detergents, antiwear agents and antioxidants.

15. A lubricating composition for reducing the tendency of nitrile elastomers to degrade when in contact with said lubricating composition, said lubricating composition comprising:

(1) a major proportion of lubricating oil;

(2) an oil-soluble active sulphur-containing additive; and (3) an oil-soluble olefinically unsaturated compound selected from:

(a) acyclic unsubstituted or substituted linear terpene compounds having at least two double bonds, adjacent double bonds being separated by two saturated carbon atoms;

(b) compounds containing an alicyclic ring, which ring contains at least eight carbon atoms and two or three double bonds, each double bond being separated from the closest adjacent double bond(s) by two saturated carbon atoms; or (c) compounds containing a saturated alicyclic ring of at least six carbon atoms and at least one exocyclic double bond;

wherein said olefinically unsaturated component (3) is at least one compound selected from the group consisting of squalene, geraniol, farnesol, 1,5-cyclooctadiene, 1,5,9-cyclododecatriene and β-pinene and said sulphur-containing additive(s) is at least one compound selected from the group consisting of: sulphurized phenols, sulphurized olefins, dithiocarbamates and, when component (3) is present as component (b), from phosphorodithioates; and provided that component (2) is not a dialkyldithiophosphoric acid salt when component (3) is present as component (a) or (c).

16. A concentrate obtained by dissolving in an oil of lubricating viscosity one or more oil-soluble active sulphur-containing additives and from one or more oil-soluble olefinically unsaturated compounds selected from:

(a) acyclic compounds having at least two double bonds, adjacent double bonds being separated by two saturated carbon atoms;

(b) compounds containing an alicyclic ring, which ring contains at least eight carbon atoms and at least two double bonds, each double bond being separated from the closest adjacent double bond(s) by two saturated carbon atoms; or (c) compounds containing a saturated alicyclic ring and at least one exocyclic double bond;

wherein said olefinically unsaturated compound is at least one compound selected from the group consisting of: squalene, geraniol, farnesol, 1,5-cyclooctadiene, 1,5,9-cyclododecatriene and β-pinene; and said sulfur-containing additive is at least one additive selected from the group consisting of sulphurized phenols, sulphurized olefins, dithiocarbamates and, said olefinically unsaturated compound is present as component (b) from phosphorodithioates; and provided that the oil-soluble active sulfur additive is not a dialkyldithiophosphoric acid salt when component (3) is present as component (a) or (c).

17. A method of treating an active sulfur-containing lubricating oil additive, concentrate or composition to increase the nitrile elastomer compatibility of said lubricating additive, concentrate or composition containing sulfur or an active sulfur-containing compound having a deleterious effect on said nitrile elastomer, said method comprising adding to said lubricating oil additive, concentrate or composition an olefinically unsaturated compound selected from:

(a) acyclic compounds having at least two double bonds, adjacent double bonds being separated by two saturated carbon atoms;

(b) compounds containing an alicyclic ring, which ring contains at least eight carbon atoms and at least two double bonds, each double bond being separated from the closest adjacent double bond(s) by two saturated carbon atoms; or (c) compounds containing a saturated alicyclic ring and at least one exocyclic double bond;

wherein said olefinically unsaturated compound is at least one compound selected from the group consisting of: squalene, geraniol, farnesol, 1,5-cyclooctadiene, 1,5,9-cyclododecatriene and β-pinene and said sulfur-containing additive is at least one additive selected from the group consisting of: sulphurized phenols, sulphurized olefins, dithiocarbamates and, when said olefinically unsaturated compound is present as component (b), from phosphorodithioates; and provided that said active sulfur-containing component is not a dialkyldithiophosphoric acid salt when said olefinically unsaturated compound comprises component (a) or (c).

* * * * *